US005168885A

United States Patent [19]

Tromblee et al.

[11] Patent Number: 5,168,885

[45] Date of Patent: Dec. 8, 1992

[54] POWER SYSTEM FOR A DISHWASHER

[75] Inventors: Jon D. Tromblee, Hagar Township, Berrien County; Vincent P. Gurubatham, St. Joseph, both of Mich.

[73] Assignee: Whirlpool Corporation, Benton Harbor, Mich.

[21] Appl. No.: 635,480

[22] Filed: Dec. 28, 1990

[51] Int. Cl.[5] ..... B08B 3/02

[52] U.S. Cl. ..... 134/105; 134/200; 134/201

[58] Field of Search ..... 18/3 R; 134/115, 105, 134/56 R, 57 R, 111, 56 D, 58 D, 57 D, 201, 200, 201

[56] References Cited

U.S. PATENT DOCUMENTS

| | | | |
|---|---|---|---|
| 1,681,322 | 8/1928 | Cave | 134/111 |
| 1,899,019 | 2/1933 | Deutsch | 134/111 X |
| 1,899,657 | 2/1933 | Zademach | 134/111 X |
| 1,927,665 | 9/1933 | Kirby . | |
| 1,961,548 | 6/1934 | Caise . | |
| 1,995,927 | 3/1935 | Kirby | 134/111 X |
| 2,018,757 | 10/1935 | Butterworth . | |
| 2,156,541 | 5/1937 | Misennimer | 68/3 R |
| 2,235,196 | 3/1941 | Bilde . | |
| 2,300,231 | 10/1942 | Landgraf | 68/38 |
| 2,314,332 | 3/1943 | Ferris . | |
| 2,368,563 | 1/1945 | Palmieri | 134/115 R X |
| 2,619,099 | 11/1952 | Young . | |
| 2,621,666 | 12/1952 | Hiort . | |
| 2,746,467 | 5/1956 | Dempsey et al. | 134/111 |
| 2,779,052 | 1/1957 | Zebarth . | |
| 2,907,335 | 10/1959 | Abresch . | |
| 3,051,184 | 8/1962 | Gibson . | |
| 3,072,128 | 1/1963 | James . | |
| 3,106,930 | 10/1963 | James . | |
| 3,126,025 | 3/1964 | Aubert et al. . | |
| 3,384,099 | 5/1968 | Baumann | 134/115 R |
| 3,457,929 | 7/1969 | Madden . | |
| 3,465,761 | 9/1969 | Meeker et al. . | |
| 3,588,835 | 6/1971 | Coburn et al. . | |
| 4,038,103 | 7/1977 | Grunewald . | |
| 4,088,145 | 5/1978 | Noren . | |
| 4,150,680 | 4/1979 | Johnson et al. . | |
| 4,462,415 | 7/1984 | Otzen | 134/111 |
| 4,651,762 | 3/1987 | Bowden | 134/111 |
| 4,776,359 | 10/1988 | Federighi, Jr. et al. . | |
| 4,781,206 | 11/1988 | Noren . | |
| 4,844,106 | 7/1989 | Hunter et al. . | |

FOREIGN PATENT DOCUMENTS

| | | | |
|---|---|---|---|
| 2360397 | 6/1974 | Fed. Rep. of Germany | 134/115 R |
| 53-9065 | 1/1978 | Japan | 134/115 R |
| 568345 | 3/1945 | United Kingdom . | |

*Primary Examiner*—Frankie L. Stinson

*Attorney, Agent, or Firm*—Hill, Van Santen, Steadman & Simpson

[57] ABSTRACT

A power system module is provided for a dishwasher that has a common base upon which is mounted the power system components. A first and second pump, heater, thermostats, overflow sensor and a fill valve are all mounted on the common base. The base member also receives an enclosure thereon which protects the components. A simple securing device in the form of a clip is utilized to hold the enclosure and base in place over a trough forming two separate sumps, one for each of the pumps.

14 Claims, 4 Drawing Sheets

POWER SYSTEM FOR A DISHWASHER

BACKGROUND OF THE INVENTION

The present invention relates to a modular power system, and more particularly to a power system for a dishwasher.

Plug-in component modules are well known and commonly used in electronic devices and non-dishwasher mechanical devices. It is not known, however, to locate power system components in a dishwasher on a common base as a removable and replaceable unit which permits the removal and replacement of the entire base and associated components in the event of failure of one or more components.

Previously known dishwashers generally include single power components located inside a dishwasher, either beneath, adjacent or above a wash cavity, and mounted on the exterior of the tub or on various interior mounting points or panels of the dishwasher.

For example, U.S. Pat. No. 4,776,359 discloses a glass washing machine having a control module which includes a pump/motor assembly disposed in a sump. A drain valve solenoid operates a drain valve for draining the sump at the appropriate time. A disadvantage to the design is the requirement that a plurality of dishwasher panels and walls, including a number of exterior finished walls, must be replaced in addition to components of the control module when the unit is refurbished or repaired. A further disadvantage to the control module is the requirement that numerous fluid connections be removed prior to removal and replacement of the control module.

U.S. Pat. No. 3,583,835, assigned to the assignee of the present invention, discloses a dishwasher motor mounting which secures a motor-pump unit to the tub of a dishwasher, the motor being suspended outside the tub and the pump being located on the interior of the tub. A sealing gasket seals the unit, which is secured to the tub by a plurality of spring clips. A disadvantage to the design is the inability to remove and replace the entire power system of the dishwasher in a single operation.

SUMMARY OF THE INVENTION

It is an object of the present invention to provide a common base for power system components in the dishwasher so that the power system components can be removed and replaced as a single unit. A further object of the invention is to provide a securing mechanism to secure the common base to the dishwasher in a simple and economical fashion. A still further object of the invention is to provide a securing mechanism which is engageable and disengageable without the use of tools. Additional objects of the invention will become apparent from the following description and specification.

The present invention overcomes the disadvantages of prior dishwashers by using a common base to mount all of the power components of the dishwasher, thereby permitting the replacement of defective parts without lengthy trouble shooting and fault diagnosis at the installation location which usually is in a user's home. In addition, the cover for the power component system both secures the base to the dishwasher and isolates the power components inside the dishwasher to prevent accidental contamination or damage to the power components. Further, the cover permits air flow into and out of the power component area for cooling purposes.

In a preferred embodiment of the invention, a fill valve, vacuum break, heater, spray pump, drain pump, thermostats, overfill switch, and blower are all mounted on a common base covered by a protective enclosure. This assembly forms an equipment module which can be built as a unit prior to final product assembly. The modular construction allows for easy assembly and field service.

The equipment module fits into a specially shaped trough molded into a plastic base of the dishwasher. The module rests on a foam rubber gasket to reduce noise transmission and the escape of water vapor from the trough. The trough serves as a sump for the spray and drain pumps as well as a reservoir for collecting and temporarily storing food soils. The trough is situated along one side of the dishwasher behind the electrical controls compartment. This arrangement reduces the overall height of the unit allowing the product to fit on a kitchen countertop beneath overhead cabinets.

The fill valve is connected to a sink faucet by a quick-connect hose assembly. Fresh water flows directly into the drain pump sump region through a vacuum break. The spray pump pulls water through a protective screen located in the bottom of the wash cavity to flow over a thermostatically controlled immersion heater. The spray pump delivers the water from the spray pump outlet through a compression gasket to a hose which hydraulically connects the trough to the spray arm. The compression gasket allows the equipment module to be installed or removed without disturbing hose connections.

DESCRIPTION OF THE PREFERRED EMBODIMENTS

Figure 1:
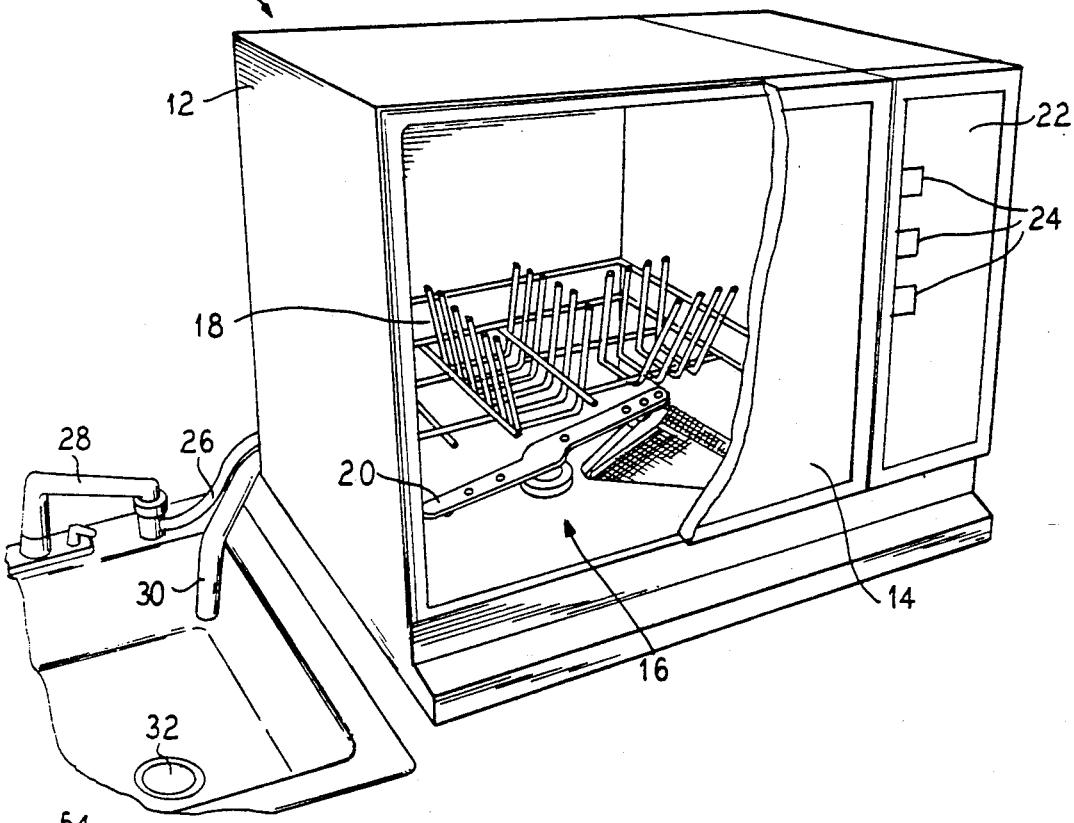
FIG. 1 is a perspective view of an automatic dishwasher incorporating the principles of the present invention.

FIG. 1 shows a dishwasher 10 having a cabinet 12 and an openable door 14. A wash chamber 16 of the cabinet 12 houses dish supporting racks 18 and a rotating spray arm 20.

A control panel 22 is provided with a plurality of controls 24 for pre-selecting the desired cycle of operation for the dishwasher.

Since the dishwasher 10 embodying the principles of the present invention may be a countertop style dishwasher, a water inlet hose 26 is shown as being connected to a kitchen faucet 28 and a drain hose 30 is shown as being directed toward a kitchen sink drain 32. Of course, the dishwasher 10 could be a built-in unit, in which case the water inlet line 26 and the drain line 30 would be permanently connected to the house plumbing.

As seen in FIG. 1, there is a dish rack 18 provided in the dishwasher. The rack may be provided with rollers 33 (FIGS. 5 and 6) for easy movement of the racks. Preferably, the rack is formed of welded wire with a plastic coating. The wire form of the dish rack is designed so as to minimize interference of the rack with spray from the spray arm 20.

Figure 2:
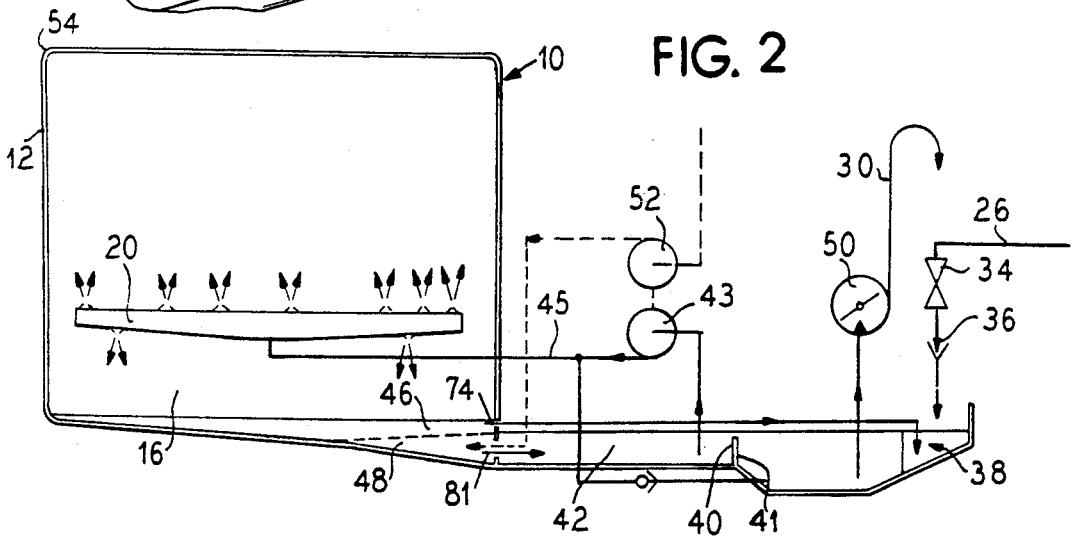
FIG. 2 is a schematic illustration of the fluid flow patterns through the dishwasher of FIG. 1.

FIG. 2 shows a schematic illustration of the fluid flow patterns within the dishwasher 10. In the schematic illustration the water inlet line 26 is shown at the far right, where it is seen that water first passes through a fill valve 34 which is operated by the dishwasher control 24. The inlet water then passes through a vacuum break 36 and into a settling chamber/drain sump 38. From the settling chamber/drain sump 38, water flows through an opening 40 in a separating wall 41 into a spray sump 42. From the spray sump 42 water is drawn by a spray pump 43 driven by a motor 44 (FIG. 4) and directed to the spray arm 20 within the wash chamber 16 through a connecting conduit 45. Water from the wash chamber 16 partially flows to a first trough 46 through an opening 74 and into the settling chamber/drain sump 38 and partially to a second trough 48 through an opening 81 back to the spray sump 42. At various times during the wash cycle, when it is desired that the wash liquid be removed from the dishwasher, a drain pump 50 driven by a motor 51 (FIG. 4) draws wash liquid from the settling chamber/-drain sump 38 and directs it to the drain line 30.

During a drying portion of the wash cycle, room air is drawn in by a blower or fan 52 operated by the spray pump motor 44. The air is directed in through the second trough 48 to flow through the wash chamber 16 to be vented through an opening 54 preferably located near the front top portion of the dishwasher cabinet 12.

Figure 3:
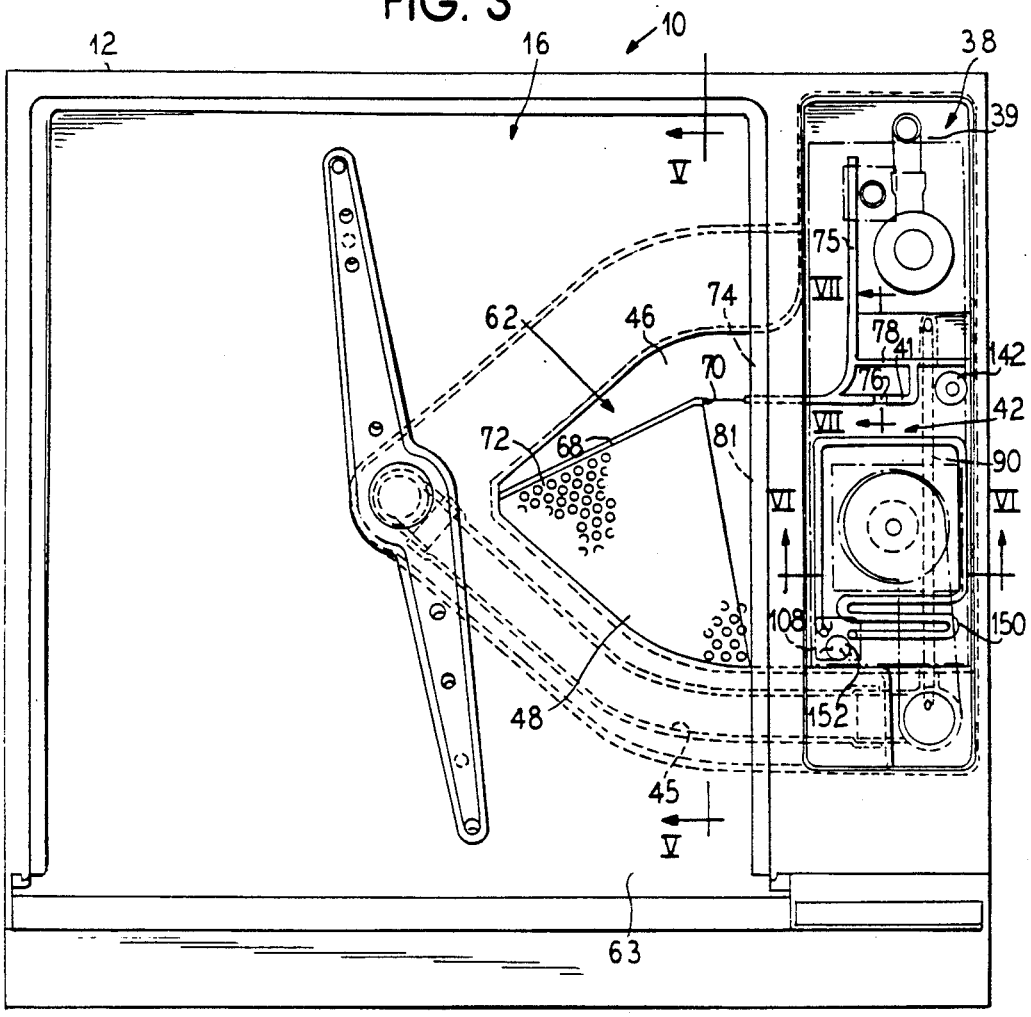
FIG. 3 is a plan, or top view of the base portion of the dishwasher of FIG. 1.
Figure 5:
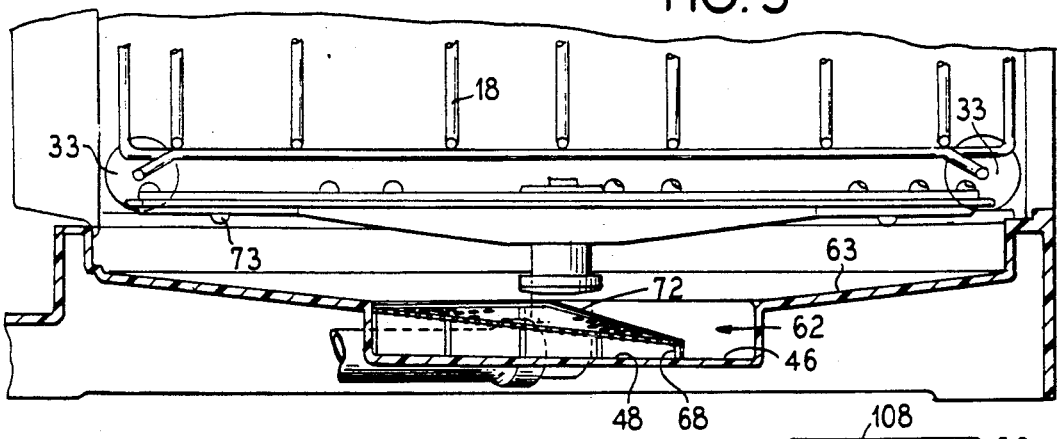
FIG. 5 is a side sectional view of the wash cavity and sump inlet areas taken generally along the line V—V of FIG. 3.
Figure 6:
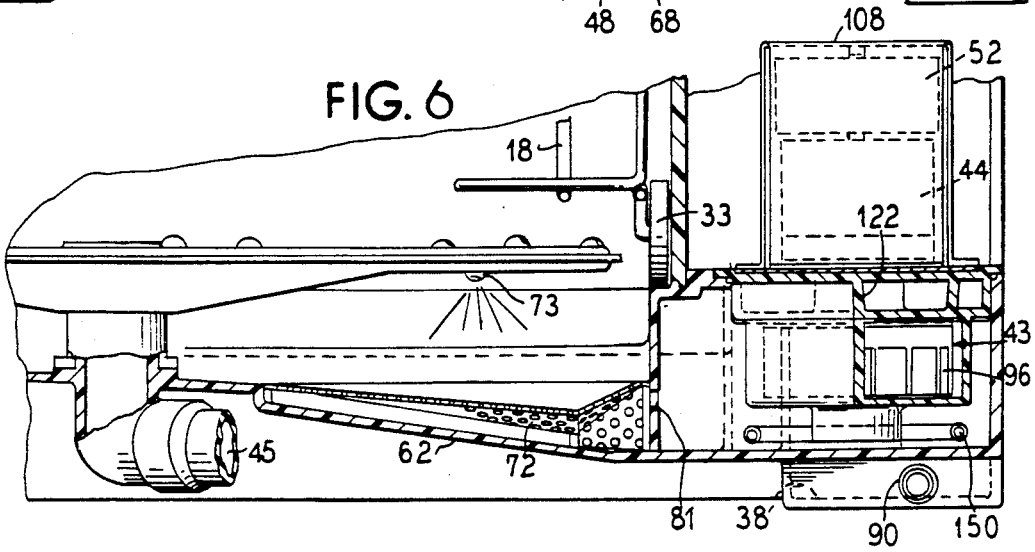
FIG. 6 is a side sectional view of the wash cavity and sump inlet areas taken generally along the line VI—VI of FIG. 3.

As best seen in FIGS. 3 and 5, wash liquid drains from the wash cavity 16 by means of a depressed area or sump 62 which preferably is molded into a bottom wall 63 of the wash chamber. The depressed area 62 is divided into the two troughs 46, 48 by a dividing wall 68 which extends along most but not the entire length of the depressed area 62. There is a communicating opening 70 through the wall 68 between the two troughs 46, 48 which assists in the draining of the dishwasher. The two trough are of unequal size, and the larger trough 48 leads to the spray sump 42, and is covered with a filter screen 72 which permits passage of liquid, but which inhibits passage of food particles.

The screen 72 is sloped downwardly toward the smaller trough 46, and thereby assists in the movement of soil particles toward the first trough.

Also, the spray arm 20 has at least one downwardly directed nozzle opening 73 which directs a spray of wash liquid against the screen 72 (FIG. 6) to assist in the cleaning of the screen and directing food particles to the first trough 46. Spray arm rotation is set so that the cleaning spray can sweep soil directly off of the filter screen 72 and into the first trough 46 leading to the settling chamber/drain sump 38. The first trough 46 leads to an opening 74 communicating with the settling chamber/drain sump 38 which is located at the lowest elevation of the dishwasher cabinet.

The settling chamber/drain sump 38 is crucial to the operation of the dishwasher, in that it enables the dishwasher to achieve an acceptable level of wash results with just four fills and one detergent addition. The settling chamber/drain sump 38 removes both lighter-than-water and heavier-than-water soils from the recirculating wash liquid. These soils are trapped in the settling chamber/drain sump 38, in which the drain pump 50 is located, so that they are disposed of quickly during the pump-out process. The settling chamber/-drain sump 38 includes an isolated chamber 39 to which soil-laden water is directed from the trough 46 in the dishwasher base unit. The entry opening 74 to the settling chamber/drain sump 38 has its top 74*a* above the operating wash liquid level. This allows floating soil to enter the chamber and prevents it from being trapped in the main washing compartment 16.

Figure 7:
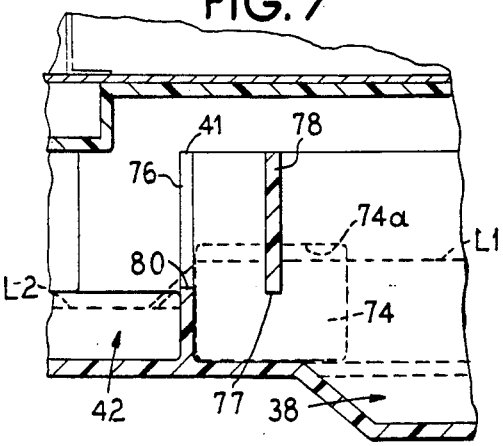
FIG. 7 is a side sectional view of the sumps separating wall taken generally along the line VII—VII of FIG. 3.
Figure 8:
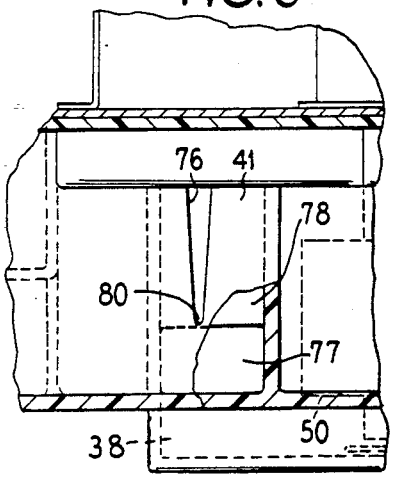
FIG. 8 is a side sectional view in the spray sump taken generally along the line VIII—VIII of FIG. 9.

The flow through the settling chamber/drain sump 38 is carefully controlled to reduce turbulence and allow soils to settle (or float) out of the wash/rinse fluid. Within the settling chamber/drain sump 38 there is a baffle wall 75 which prevents turbid fluid from the wash chamber 16 from flowing directly into the isolated chamber 39. During the wash cycle as fluid flows through the trough 46 into the settling chamber/drain sump 38, it is permitted to flow then into the spray sump 42 through the opening 76, which is in the form of a V-shaped notch (FIGS. 3,7 and 8) formed in the wall 41 that isolates the settling chamber/drain sump from the spray sump.

The V-notch 76 is sized so that a flow rate of approximately one half gallon per minute is maintained through the V-notch when the spray pump 43 is operating. The flow of wash liquid from the settling chamber/drain sump 38 to the spray sump 42 is directed through an opening 77 (FIGS. 7,8) under an appropriately spaced wall 78 so that floating soil is trapped in the settling chamber/spray sump before it gets to the V-notch 40. A bottom 80 of the V-notch 40 is high enough to trap heavy soil that has settled to the bottom of the isolated chamber 39. The flow velocity through the settling chamber/drain sump 38 is normally relatively slow, thus allowing heavier-than-water soils to settle, and lighter-than-water soils to rise.

The screen 72 provides a small impedance of the flow of wash liquid from the wash cavity sump 62, through an opening 81 communicating with the spray sump 42. This impedance produces a wash liquid level that is higher in the settling chamber/drain sump 38 than the level in the spray sump 42, and provides the driving force that gives the above-mentioned one half gallon per minute separator flow.

The system described is self-regulating. In the exemplary embodiment, the settling chamber/drain sump 38 is designed for a one half gallon per minute flow of relatively clean wash liquid. When heavy soils are encountered, the protecting filter screen 72 may become partially blocked. This increases the flow impedance to the spray pump 43 and creates a greater fluid level difference between the spray sump 42 and the isolated chamber 39 of the settling chamber/drain sump 38. As the fluid level in the spray sump 42 drops, the effective fluid passage area through the V-notch 40 increases. The result is that the fluid flow rate through the V-notch 40 increases until the heavy soil is pulled from the surface of the screen 72 and into the settling chamber/-drain sump.

As a result, the filter screen blockage has been eliminated, flow impedance is returned to normal, and then flow through the settling chamber/drain sump returns to the one-half gallon per minute rate. The result is very rapid removal of large soil particles from the wash water followed by removal of the fine soil particles. The slow relatively turbulence-free flow through the settling chamber/drain sump 38 also minimizes the suspension and homogenizing action that occur between detergent and soil in a highly agitated system. The result is that little detergent is used by the soil trapped in the settling chamber/drain sump 38. This means that more detergent remains available in the water for cleaning of the dishes, or, alternatively, less detergent addition is needed to perform the cleaning function.

At appropriate times during the wash cycle the wash liquid within the dishwasher is pumped by drain pump 50 through the drain line 30 to remove wash liquid and collected soil particles from the dishwasher. A soil chopper 82 (FIG. 4), including a single wire pressed at a right angle through an extension 84 of the pump impeller, is located just below an impeller opening 86 of the drain pump 50. The proximity of the chopper 82 to the impeller opening 86 is chosen such that the chopper 82 chops all soil to a size that can pass through both the pump 50 and the drain hose 30 of the system. A pump capacity of approximately one gallon per minute has been determined to be sufficiently large to provide the necessary pump out operation.

A separate drain line 90 (FIG. 4) is provided between the spray conduit 45 and the drain pump 50 to permit a pump out of all wash liquid within the system. The drain line 90 includes a check valve 92 which is closed when the spray pump 43 is in operation, but which moves to an open position, allowing draining to the settling chamber/drain sump 38, when the spray pump 43 is not in operation.

Both the spray pump 43 and drain pump 50 of the power system are designed to operate without pump seals. This is facilitated by the fact that both of the motors are well above the operating wash liquid level. To facilitate the no-seal design, impellers 94, 96 of the pumps 50, 43 have pumping elements or impeller blades 98, 100 on both sides. The pumping element 100 on the motor side of the impeller counteracts the pressure developed by the main impeller pumping element 98. This prevents pressurized water from escaping through a clearance space 102 between a motor shaft 104 and the pump body 106. This design eliminates both manufacturing and service costs associated with pump seals. It also allows the pumps to be run "dry" with no chance for seal damage.

Since running dry is possible, the spray pump motor 44 is fitted with the fan 52 that serves both to cool the motor and to provide forced air for drying within the dishwasher. A cover 108 is provided which surrounds the motors 44, 51 and fan 52, and which is secured to a subassembly base 110 carrying the motors 44, 51 by an appropriate fastener arrangement such as a tab in groove connection 112 at one end 114 and a wire rod clip 116 secured between the cover 108 and the dishwasher base 118 at an opposite end 120.

The subassembly base 110 has a passage 122 molded therein which permits air from outside the cover 108 to be drawn into an area 124 enclosed by the cover 108. More particularly, the air is drawn through the passage 122 into openings 126 which are within a separate cover 128 enclosing the motor 44. The air is then drawn through an opening 130 in the motor cover 128 into the fan 52 which then pressurizes the area 124 within the cover 108.

Figure 9:
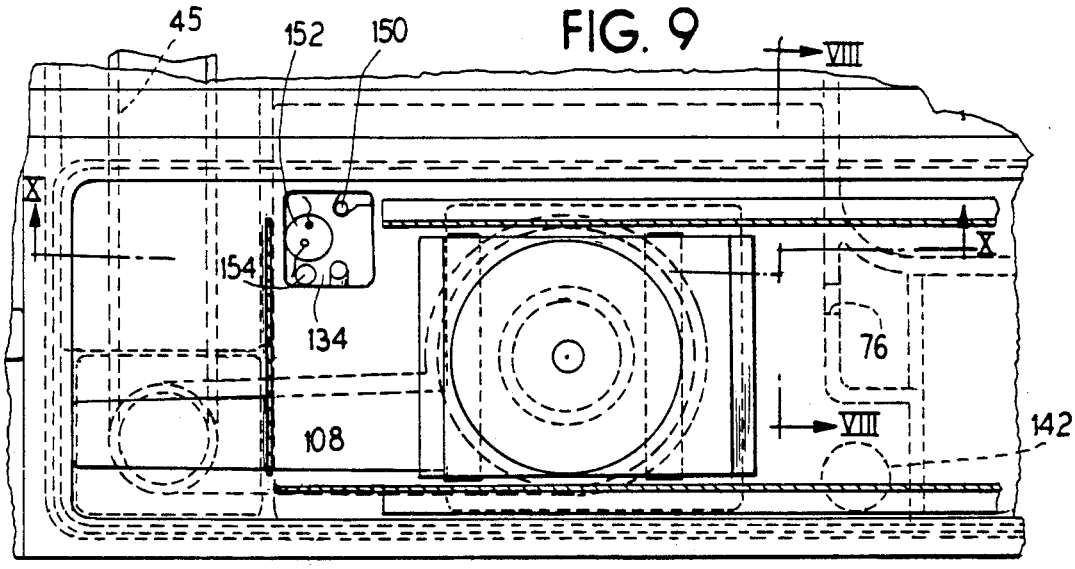
FIG. 9 is a top sectional view of the electrical module taken generally along the line IX—IX of FIG. 4.
Figure 10:
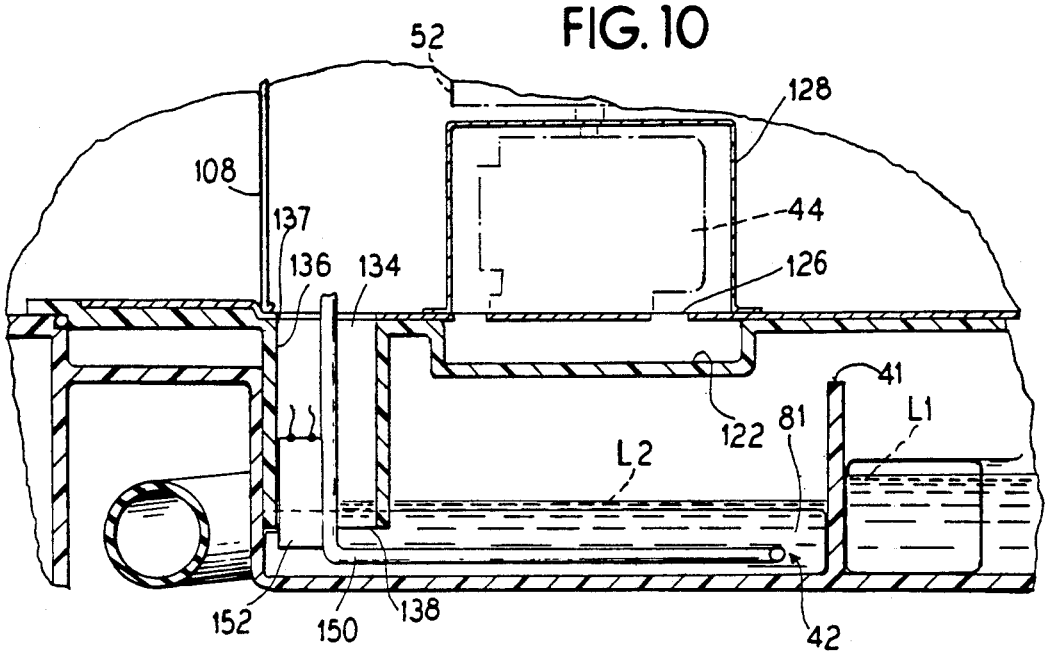
FIG. 10 is a side sectional view of the spray sump taken generally along the line X—X of FIG. 9.

Two air outlets are provided for the pressurized air. A first outlet 132 is one or more small vent openings in the cover 108 leading back into the area enclosed by the dishwasher cabinet 12. A second outlet 134 (FIGS. 9, 10) leads to the washing chamber 16; however, this outlet is designed so that no air can flow through the washing compartment 16 when the machine is operating in a wash or rinse mode. This is accomplished by providing an air duct 136 having an inlet opening 137 open to the interior of the cover 108 and an outlet opening 138 open to the spray sump 42. The outlet opening 138 to the spray sump 42 is covered by wash (or rinse) liquid at level L2 or higher when the machine is in the wash (or rinse) mode of operation.

When the liquid is pumped out of the sumps 38, 42, the liquid level therein drops below the outlet opening 138, thus permitting air from the interior of the housing 108 to flow through the air duct 136. Since the outlet opening 138 provides a larger cross-sectional area for air flow than the first cutlet 132, most of the air flow generated by the fan 52 passes through the air duct 136 and into the spray sump 42. From the spray sump 42, the air flows directly into the washing chamber 16 through the channel 48 and through the screen 72, thus drying the screen. Further, since the motor 44 that runs the fan 52 also runs the pump 43, air will be pumped through the spray arm 20 and will therefore dry out the interior of the spray arm.

Air control through the wash chamber 16 is needed since it is undesirable to have air flowing through the dishwasher during washing and rinsing. Excessive moisture and heat losses would occur should pressurized air be introduced into the wash cavity during the wash or rinse mode. When the machine is washing or rinsing, the spray pump fan 52 still provides cooling air for the pump motor 44. The air path through the wash chamber (drying air) presents significantly lower resistance to airflow than the vent openings in the cover 108; hence the air path through the wash chamber is the principal path used when the machine contains no wash liquid.

In order to reduce manufacturing costs, the dishwasher may be constructed in a modular fashion with many of the structural components molded as a unit. For example, the washing compartment may be molded as a single unit. Also a molded base unit 139 may be provided which contains both the settling chamber/-drain sump 38 and the spray sump 42 as well as the above described walls 75, 41.

Figure 4:
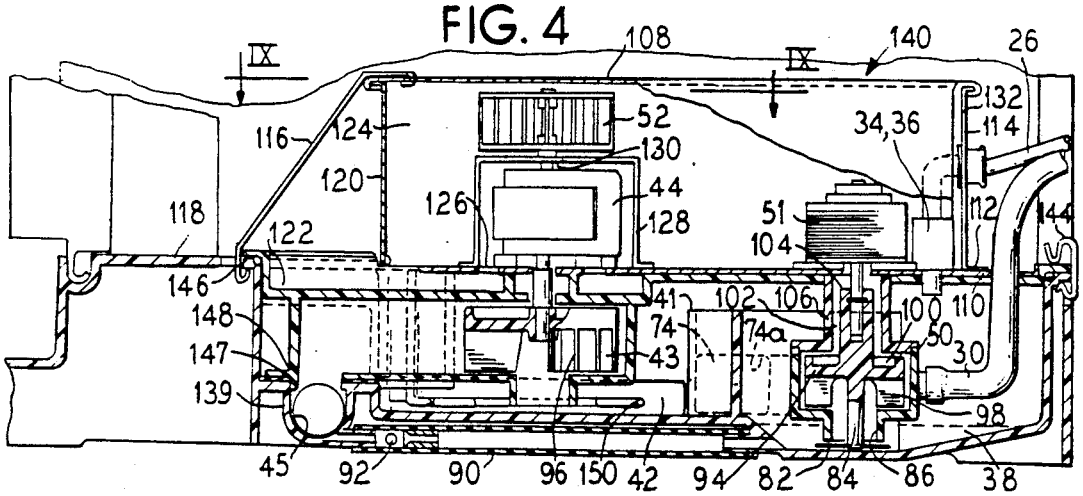
FIG. 4 is a side sectional view of the sumps and pumps area taken generally along the line IV—IV of FIG. 3.

A power module 140 (carried on the subassembly base 110) may be provided which carries the drain pump 50 and its motor 51, the spray pump 43, its motor 44, and the fan 52, as well as other components such as an overfill protect float 142 (FIGS. 3 and 9) and fill valve 34 and vacuum break 36 (FIG. 4). The power module 140 can be assembled onto the base unit 139 by a minimum of fasteners, such as a clip 144 and the connecting rod 116 with a seal 146 being provided between the two units. A seal member 147 is also provided where an outlet 148 of the spray pump 43 joins the connecting conduit 45 leading to the spray arm 20.

The spray pump 43, located at the front of the power module 140, is centered in the spray sump 42 molded in the base unit 139. The pump 43 is surrounded by a tubular electrical heating element 150. The heating element 150 is formed in a simple geometric shape to heat fluid throughout the sump 42, and is carefully located so that it is spaced away from direct contact with any of the molded plastic parts of the system. In the exemplary embodiment, heating element power is 1200 watts and provides a temperature rise of about 3° fahrenheit per minute. The spray pump flow rate is approximately eight gallons per minute.

The control system may either be electronic or electromechanical. In the illustrated embodiment, the control is designed for a timed- fill with a float switch overfill protection. The control is designed to be a complete subassembly located at the dishwasher front to the right of the washing compartment 16. The control provides a temperature hold on selected parts of the cycle. A 140° fahrenheit temperature hold thermostat 152 is installed in the machine power module along with a second safety thermostat 154 that shuts off the water heater element 150 in the event of an over-temperature condition. The safety thermostat 154 operates independently of the control module.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a dishwasher having a wall defining a wash cavity, spray means for distributing wash liquid within said wash cavity, and drain means located within said wash cavity for draining wash liquid from said wash cavity to a sump exterior of said cavity, a power system comprising:

base means for mounting power system components thereon;

first pump means mounted to said base means for providing liquid to said spray means;

second pump means mounted to said base means for pumping water outside of said dishwasher;

said base means removably secured to and forming an upper wall for said sump such that at least one of said pump means will be positioned in said pump.

2. A power system according to claim 1, further including heating means for heating said wash liquid mounted to said base means.

3. A power system according to claim 1, further including a fill valve mounted on said base means for introducing wash liquid into said dishwasher, an overfill protect float switch mounted on said base means for sensing an overfill condition and providing a signal indicating said overfill condition, and at least one thermostat mounted on said base means for sensing a heated condition of said water and providing a signal indicating said heated condition.

4. A power system in a dishwasher according to claim 1, further including enclosure means for enclosing said power system, said enclosure means including securing means for releasably securing said enclosure means and said power system to said dishwasher, whereby said power system is removable and replaceable as a single unit.

5. A power system module for a dishwasher having a sump comprising:

common base means for mounting a plurality of power system components thereon, said base means forming an upper wall for said sump;

a first pump mounted on said base means and having a portion extending into said sump;

a second pump mounted on said base means;

a heating means mounted on said base means;

means for removing said base means and said power system components from said dishwasher and said sump as a single unit.

6. A power system module according to claim 5, further including a fill valve mounted on said base means for introducing wash liquid into said dishwasher.

7. A power system module according to claim 5, further including an overfill protect float switch mounted on said base means for sensing an overfill condition and providing a signal indicating said overfill condition.

8. A power system module according to claim 5, further including at least one thermostat mounted on said base, means for sensing a heated condition of said wash liquid and providing a signal indicating said heated condition.

9. A power system module according to claim 5, further including enclosure means for enclosing said power system components, said enclosure means including securing means for releasably securing said enclosure means and said power system module to said dishwasher, whereby said power system module is removable and replaceable as a single unit.

10. A dishwasher comprising:

at least one wall defining a wash cavity;

spray means for distributing wash liquid within said wash cavity;

drain means located within said wash cavity for draining wash liquid from said wash cavity;

base means for mounting power system components thereon;

enclosure means for enclosing said power system components mounted on said base means; and at least one pump mounted on said base means;

a sump exterior of said wash cavity, said drain means draining said wash liquid to said sump;

said base means being positioned to overlie and form an upper wall for said sump such that said pump will be positioned in said sump; and securing means for releasably securing said enclosure means and said base means to said sump.

11. A dishwasher according to claim 10, including a second pump mounted on said base means.

12. A dishwasher according to claim 10, further including a fill valve mounted on said base means for introducing wash liquid into said dishwasher.

13. A dishwasher according to claim 10, further including an overfill protect float switch mounted on said base means for sensing an overfill condition and providing a signal indicating said overfill condition.

14. A dishwasher according to claim 10, further including at least one thermostat mounted on said base means for sensing a heated condition of said wash liquid and providing a signal indicating said heated condition.

* * * * *